United States Patent [19]

Smith

[11] Patent Number: 4,657,245

[45] Date of Patent: Apr. 14, 1987

[54] EXERCISING DEVICE

[76] Inventor: Brett A. Smith, 803 S. Gary Pl., Tulsa, Okla. 74104

[21] Appl. No.: 483,143

[22] Filed: Apr. 8, 1983

[51] Int. Cl.[4] ..... A63B 21/00

[52] U.S. Cl. ..... 272/117; 272/134

[58] Field of Search ..... 272/117, 116, 134, 143, 272/93, 123, 124, 118, 136, 142, 901

[56] References Cited

U.S. PATENT DOCUMENTS

| | | | |
|---|---|---|---|
| 169,467 | 11/1875 | Newbrough | 272/134 X |
| 799,270 | 9/1905 | Roland | 272/117 |
| 911,925 | 2/1909 | Del Valley Zepo | 272/142 X |
| 2,767,985 | 10/1956 | Maxcey et al. | 273/55 R |
| 3,524,644 | 8/1970 | Kane . | |
| 3,708,167 | 1/1973 | Potgieter | 272/117 |
| 3,850,430 | 11/1974 | Hamilton | 272/143 X |
| 3,905,599 | 9/1975 | Mazman . | |
| 4,068,843 | 1/1978 | Frost | 272/118 |
| 4,093,213 | 6/1978 | Coker et al. | 272/118 |
| 4,211,403 | 7/1980 | Coffaro et al. | 272/134 |
| 4,266,766 | 5/1981 | Calderone . | |
| 4,344,619 | 8/1982 | Szabo | 272/117 |

*Primary Examiner*—Richard J. Apley
*Assistant Examiner*—Robert W. Bahr
*Attorney, Agent, or Firm*—John D. Gassett

[57] ABSTRACT

An exercising device especially for strengthening the triceps as well as the frontal deltoid. A horizontal bench is provided upon which the exerciser may lie. At one end of the bench is a short post and at the other end is a higher upright track having a vertical guideway. A bar is pivotally attached at one end to said short post and the other or weight end extends through said guideway. Various size weights may be added to the weight end.

8 Claims, 1 Drawing Figure

EXERCISING DEVICE

BACKGROUND OF THE INVENTION

1. Field of the Invention

This invention relates to an exercise machine for strengthening muscles, and especially those muscles of the tricep and frontal deltoid.

2. Statement Regarding Exercising Devices

There are numerous exercise devices for strengthening muscles of human beings. Different devices are designed to strengthen certain muscles. There is one set of muscles for which no prior machine gives adequate exercise. That set of muscles includes the triceps. The present invention described herein is for an exercising device which, at last, provides excellent exercise for the triceps as well as the frontal deltoid.

BRIEF SUMMARY OF THE INVENTION

This is an exercise machine for strengthening muscles of the human body and is especially good for the triceps including all three heads. To a lesser extent it also helps develop the forearm, the pectoral and the deltoid.

The machine duplicates the exercising motion of a one-arm push up. The exerciser lies on his back and with one hand grasps the handle for a weight directly with such handle being above his face. The axis of the handle is in the essentially same plane as is a longitudinally line drawn through the exerciser. The weight is pushed directly up and then lowered. In a preferred embodiment a bench is provided upon which the exerciser may lie with his face up. On one end of the bench is a short post about 12 to 15 inches high and at the other end is an upright track about three to four feet high with a vertical guide slot. A long bar is pivotally attached at one end to the short post and the other end extends through the guide slot. Variable weights may be added to the bar end extending through the guide slot.

For a more complete understanding of the invention and a better description attention is directed to the following detailed description and accompaning drawing.

BRIEF DESCRIPTION OF THE DRAWING

The drawing shows an isometric view of the exercising machine of this invention.

DETAILED DESCRIPTION OF THE PREFERRED EMBODIMENT

Figure 1:
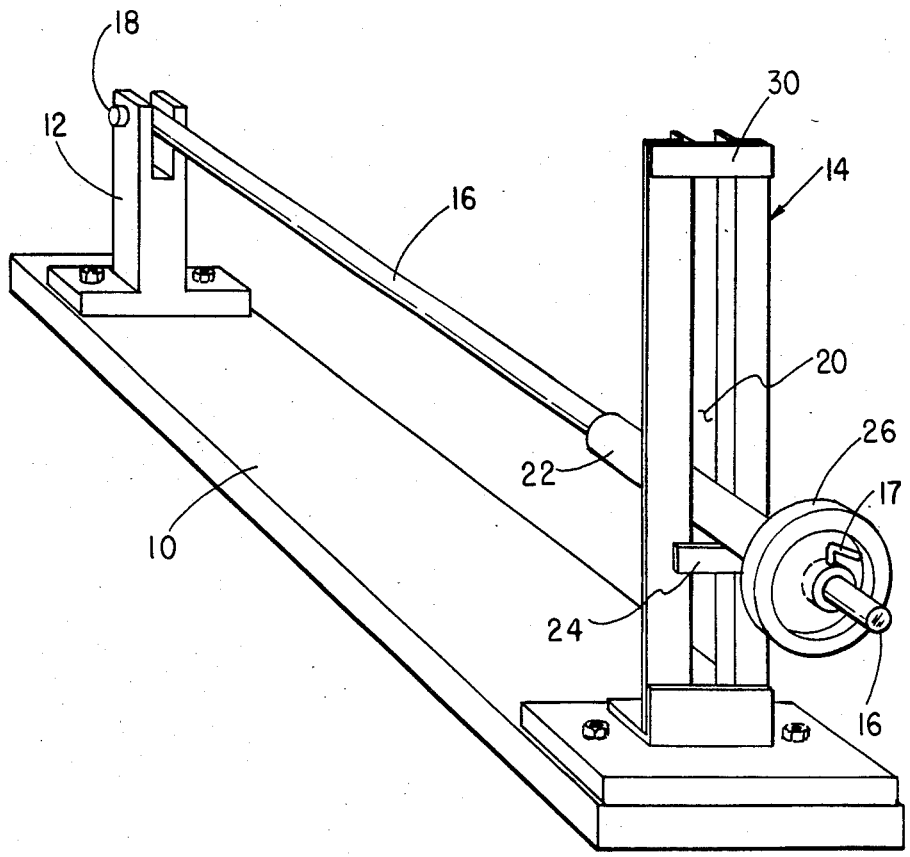

Attention is directed to the drawing which shows the preferred embodiment of the invention. Shown thereon is a bench 10 which may be a padded board of a size to support an exerciser. Typically the bench may be two to three feet wide and six to seven feet long. On one end of the bench 10 is an upright post 12. At the other end is an upright track 14 having a vertical guide way 20 having a stop 24 at its lower end. One end of bar 16 is pivotally connected to upright post 12 at pivot 18. The bar 16 extends through guideway 20. The axis of bar 16 is preferably in the same plane as is the longitudinal axis of bench 10. Weights 26 are positioned on the free end bar 16 and held in place by means such as set screw 17. A hand hold or handle 22 is provided on bar 16 adjacent track 14 and on the inner side thereof, i.e. on the side nearest pivot 18. The handle 22, which for maximum strengthening of the exerciser, has a longitudinal axis which is the same as or parallel to the longitudinal axis of bar 16. The handle may be a part of bar 16 but is preferably enlarged and padded for comfort. Bar 16 can be raised from its at rest position where it is resting on stop 24 as shown in the drawing to an upper position which would accomodate the upper extension of the extended arm of the exerciser. The movement of and the longitudinal axis of slot 20 is about pivot 18.

As an example, the upright post may be made of angle iron secured to the bench. Pivot 18 is preferred about 12 inches above the bench. Upright track 14 can be two angle irons separated to provide for guideway 20. The two angle irons can be held together by stop 24 and upper cap 30. The two angle irons are attached to bench 10 in any secure manner. Bar 16 is preferably steel and is about 1" in diameter and about six to eight feet in length. Handle 22 can be an enlarged portion of bar 16 or it may be a molded resilient member such as reasonably firm rubber which is comfortable to the hand. Stop 24 is preferably the same distance above the upper surface as is pivot 18. The main function of this exercise machine is to strengthen the muscles of the triceps (all three heads) and the front deltoid. To a lesser extent the machine also strengthens the forearm, the pectoral and the deltoid.

To use this machine, the exerciser lies on his back on bench 10 with the head adjacent track 14 and the feet near or on either side of upright post 12. One hand is placed on handle 22 directly above the face. This hand is then extended the full length of the arm pushing the bar up away from the face. Weight 26 is selected to give the desired effort required to push bar 16 the extended distance. After extending the bar, it is slowly lowered to its original position. This may be repeated as often as necessary to obtain the progress desired. The same exercise is then repeated using the other hand. The force on the exerciser is essentially the same throughout the extension and lowering of bar 16 and weight 26. Weight 26 is held in position on bar 16 by any known means and is held sufficiently far from track 14 so that it does not hit it when bar 16 is lifted along its arc to its upper position. This exercise, as far as the muscles mentioned above are concerned closely duplicates the muscle exercise of one-arm push ups. I know of no other exercising machine that duplicates this particular motion. However the use of this machine is better than attempted one-arm pushups. For example one can start strengthening these muscles with rather low weights, much less than the weight which must be lifted in a one-arm push up. Further, after a great deal of strength is built up, weights in excess of the weight of the exercisers body can be used. The strengthening of these particular muscles are important for many athletes and are especially important to football players required to block or "shove-off" with their arms. Although this description has been made in detail, various modifications can be made thereto without departing from the spirit or scope of the invention.

What I claim is:

1. An exercise machine comprising:

(a) an upright post;

(b) an upright track spaced from said upright post in a rigid relationship therewith and having a guideway;

(c) a bar pivotably connected at one end to a pivot supported by said upright post and the other end extending to said guideway so that said bar may pivot about said pivot;

(d) resistance at a fixed point on the other end of said bar near said guideway positioned on said bar so that said bar may pivot about said pivot;

(e) a hand hold supported by said bar between said upright post and said upright track.

2. A machine as defined in claim 1 in which said guideway is an elongated vertical slot through which said bar extends and in which said resistance is weight.

3. An exercise machine comprising:

a bench having a longitudinal axis along which an exerciser may lie;

an upright post located at one end of said bench and rigidly secured thereto;

an upright track at the other end of said bench, said track having a guideway with an opening having a center line in the same plane as the longitudinal axis of said bench;

a weight bar pivotably connected at one end to said upright post, the other end of said bar through said guideway;

a resistant at the said other end of said bar.

4. A machine as defined in claim 3 in which the opening of said guideway is an elongated vertical slot through which said bar extends and having its lower end a selected distance above said bench and in which said resistance is a heavy object.

5. A machine as defined in claim 4 in which said selected distance is about twelve inches and in which said bench is at least about six feet long.

6. A machine as defined in claim 5 in which said track is at least about three feet high.

7. An exercise machine comprising:

a bench upon which an exerciser may recline along a longitudinal line;

a pivot supported by said bench;

an upright member having a vertical guideway whose lower end is a selected distance above said bench and having an opening with its center line in the same plane as said longitudinal line;

a weight;

a bar for supporting said weight and movable along said vertical guideway such that said weight can move in an arc having its center at said pivot, said bar having a hand hold having a longitudinal axis in a vertical plane containing said longitudinal line of said bench, said handhold being between said upright member and said pivot.

8. An exercise machine comprising:

a bench having a longitudinal axis along which an exerciser may lie;

an upright post at one end of said bench;

an upright track at the other end of said bench, said track having a guideway with an opening having a center line in the same plane as the longitudinal axis of said bench, the opening being an elongated vertical slot and having its lower end a selected distance above said bench;

a weight bar pivotally connected at one end to said upright post, the other end of said bar extending through said vertical slot;

a resistance which is a heavy object at the other end of said bar.

* * * * *